US006375386B1

(12) United States Patent
Macku et al.

(10) Patent No.: US 6,375,386 B1
(45) Date of Patent: Apr. 23, 2002

(54) METHOD OF REMIXING HOT MIX ASPHALT MATERIAL IN AN ASPHALT PAVER AND A MAT OF ASPHALT MATERIAL HAVING UNIFORM AGGREGATE DISTRIBUTION MADE BY THE SAME

(75) Inventors: Charles G. Macku, Cedar Rapids, IA (US); John A. Trygg, Milford, KS (US)

(73) Assignee: Cedarapids, Inc., Cedar Rapids, IA (US)

( * ) Notice: Subject to any disclaimer, the term of this patent is extended or adjusted under 35 U.S.C. 154(b) by 0 days.

(21) Appl. No.: 09/628,056

(22) Filed: Jul. 28, 2000

Related U.S. Application Data

(63) Continuation of application No. 09/135,503, filed on Aug. 17, 1998, now Pat. No. 6,099,205, which is a continuation of application No. 08/918,089, filed on Aug. 25, 1997, now Pat. No. 6,007,272, which is a continuation of application No. 08/567,431, filed on Dec. 5, 1995, now abandoned.

(51) Int. Cl.[7] ..... E01C 11/00
(52) U.S. Cl. ..... 404/17; 404/101; 404/108
(58) Field of Search ..... 404/75, 101, 108, 404/118; 15/235.4

(56) References Cited

U.S. PATENT DOCUMENTS

| | | | | |
|---|---|---|---|---|
| 2,067,236 A | | 1/1937 | Hepburn | |
| 3,217,620 A | | 11/1965 | Mindrum et al. | |
| 3,771,893 A | * | 11/1973 | Miller | 404/101 |
| 4,040,571 A | | 8/1977 | Lindeborg | |
| 4,068,970 A | | 1/1978 | Rowe | |
| 4,103,788 A | | 8/1978 | Sutton | |
| 4,154,372 A | | 5/1979 | Ricciardi | |
| 4,453,856 A | * | 6/1984 | Chiostri et al. | 404/91 |
| 4,714,374 A | | 12/1987 | Mihara | |
| 4,749,304 A | * | 6/1988 | Craig | 404/101 |
| 5,002,426 A | | 3/1991 | Brown et al. | |
| 5,240,321 A | | 8/1993 | Miller | |
| 5,354,189 A | | 10/1994 | McKinnon | |
| 5,529,247 A | | 6/1996 | Mleczewski | |
| 5,533,829 A | | 7/1996 | Campbell | |
| 5,553,969 A | | 9/1996 | Reed | |
| 5,584,641 A | | 12/1996 | Hansen | |
| 5,622,323 A | | 4/1997 | Krueger et al. | |
| 5,752,782 A | | 5/1998 | Hulicsko | |
| 6,000,649 A | | 12/1999 | Loppoli | |
| 6,007,272 A | | 12/1999 | Macku et al. | |

* cited by examiner

*Primary Examiner*—Thomas B. Will
*Assistant Examiner*—Raymond W Addie
(74) *Attorney, Agent, or Firm*—Marshall, Gerstein, & Borun

(57) ABSTRACT

An asphalt paver having a remixing conveyor system that is adapted to substantially or entirely eliminating segregation in hot mix asphalt material delivered to the asphalt paver. The remixing conveying system includes at least one pair of parallelly spaced, oppositely pitched, counter-rotating hydraulically driven feed augers having remixing blades that intermittently displace portions of the hot mix asphalt material generally transversely to the direction that the feed augers convey the hot mix asphalt material from a hopper of the asphalt paver to spreading augers near the rear of the machine. Elongate members over the feed augers provide protection from impact forces and overloading and enhancing lateral extraction of hot mix asphalt material from the hopper. An optional feed screen provides flow control of the hot mix asphalt material in the hopper. A kit is provided for converting existing asphalt paving machines to have desegregating capability. A method is provided for substantially or entirely eliminating segregation in hot mix asphalt material delivered to an asphalt paver.

10 Claims, 2 Drawing Sheets

METHOD OF REMIXING HOT MIX ASPHALT MATERIAL IN AN ASPHALT PAVER AND A MAT OF ASPHALT MATERIAL HAVING UNIFORM AGGREGATE DISTRIBUTION MADE BY THE SAME

RELATED APPLICATIONS

This application is a continuation of Ser. No. 09/135,503, filed Aug. 17, 1998, now U.S. Pat. No. 6,099,205 which was a continuation of Ser. No. 08/918,089, filed Aug. 25, 1997, now U.S. Pat. No. 6,007,272, which was a continuation of Ser. No. 08/567,431, filed Dec. 5, 1995, now abandoned.

BACKGROUND OF THE INVENTION

1. Field of the Invention

The present invention relates generally to conveyors for aggregate material and, more particularly but without limitation, to conveyors for conveying hot mix asphalt material in an asphalt paving machine.

2. Description of the Related Art

Hot mix asphalt material used in highway construction and the like ideally consists of a uniform mixture of several sizes of mineral aggregate and liquid bituminous asphalt cement. When properly blended in the correct proportions, the hot mix asphalt material provides a uniform and durable material that is capable of withstanding heavy traffic and loads over a long service life. In the process of producing the hot mix asphalt material and delivering it to a construction site for placement by an asphalt paver, however, the mixture may tend to separate into its constituent parts, a condition commonly referred to in the industry as "segregation".

For instance, the hot mix asphalt material produced at the production plant is often loaded into a storage silo to await trucks for transport to the construction site. As the hot mix asphalt material is carried by a conveyor to the top of the silo, the larger sized aggregate contained in the hot mix asphalt material tends to separate from the smaller sized aggregate material contained therein. Further, as the hot mix asphalt material is dropped from the conveyor into the silo, the larger sized aggregate tends to roll to the lower periphery of the pile of hot mix asphalt material typically forming a pyramid near the center of the silo, while the smaller sized aggregate tends to cling to the top and sides of the pile. The hot mix asphalt material within the silo is, therefore, no longer a uniform mixture as desired but, instead, is a segregated mixture consisting of a surplus of larger sized aggregate near the outer wall of the silo and a paucity of larger sized aggregate nearer the center of the silo.

Similarly, as the hot mix asphalt material is discharged from the silo into trucks for transport, larger sized aggregate tends to roll to the extreme corners of the truck box while the smaller sized aggregate tends to remain more toward the center of the truck box. The truck therefore contains a segregated mixture consisting of a surplus of larger sized aggregate at the front, rear and sides of the truck box and a paucity of larger sized aggregate nearer the center of the truck box.

An asphalt paver at the construction site is generally a state-of-the-art self-propelled construction machine designed to receive, convey, distribute, profile and partially compact the hot mix asphalt material. The paver accepts the hot mix asphalt material into a receiving hopper at the front of the machine, conveys the material from the hopper to the rear of the machine with parallel slat conveyors, distributes the hot mix asphalt material along the width of an intended ribbon or mat by means of two opposing screw or spreading conveyors, and profiles and compacts the hot mix asphalt material into a mat with a free-floating screed.

Each slat conveyor that moves the hot mix asphalt material from the receiving hopper to the rear of the paving machine generally consists of two parallel slat chains with a multitude of transverse slats connected there between. Each slat chain is pulled by one of two sprockets mounted on a common shaft which, in turn, is driven by appropriate power transmission chains, gear boxes or the like. Because the slat conveyor pulls the hot mix asphalt material from the hopper in a bulk mass with little or no remixing, any segregated characteristics of the hot mix asphalt material as it exists in the hopper continues to exist in the hot mix asphalt material as it is placed by the opposing screw conveyors on the subgrade in front of the screed.

Thus, when the undesirably segregated, hot mix asphalt material is delivered to the construction site and placed by the asphalt paver, the mat produced is not of uniform consistency but, instead, contains regions having a surplus of larger sized aggregate and a paucity of smaller sized aggregate and, likewise, regions with a surplus of smaller sized aggregate and a paucity of larger sized aggregate. As a result, the mat produced from the segregated material does not possess the desired mechanical properties and generally will not withstand the anticipated loads and stresses as well as a mat constructed of non-segregated, or uniform, hot mix asphalt material.

What is needed is an apparatus that is capable of, and a method for, remixing segregated hot mix asphalt material just before the hot mix asphalt material is placed on a subgrade by an asphalt paver whereby the detrimental effects of segregation are substantially or totally eliminated.

SUMMARY OF THE INVENTION

An improved asphalt paver having a remixing conveyor system is provided for substantially or entirely eliminating segregation in hot mix asphalt material delivered to the asphalt paver. The remixing conveying system includes at least one pair of parallelly spaced, oppositely pitched, counter-rotating feed augers, each auger of which has remixing blades that intermittently displace portions of the hot mix asphalt material generally transversely to the direction that the feed augers convey the hot mix asphalt material from a hopper of the asphalt paver to spreading augers that are used to laterally distribute the hot mix asphalt material near the rear of the machine. In order to regulate the rate at which hot mix asphalt material is placed by the asphalt paver, the feed augers are driven by speed-controllable hydraulic motors.

A plurality of elongate members, one above each of the feed augers, are adapted to provide protection for the respective feed augers from impact forces generated as hot mix asphalt material is dumped into the hopper, to prevent overloading of the feed augers that might otherwise arise from excessive hot mix asphalt material being heaped on the feed augers, and to promote enhanced lateral extraction of the hot mix asphalt material from the hopper by the feed augers. A feed screen, having a mesh-like structure constructed of bar or rod material and generally supported by the elongate members, may be optionally used to further enhance the extent of lateral extraction of the hot mix asphalt material from the hopper by the feed augers.

The present invention also provides a kit for replacing each conventional slat conveyor of an existing asphalt paving machine with two parallel, oppositely pitched, counter-rotating feed augers that serve the purpose of the slat conveyors in moving hot mix asphalt material through the paver from the hopper to the spreading augers, but also serve the purpose of remixing the hot mix asphalt material into a uniform consistency and thereby provide desegregating capability in an existing paving machine.

The present invention also provides a method for substantially or entirely eliminating segregation in hot mix asphalt material delivered to an asphalt paver. The method includes displacing the hot mix asphalt materials intermittently generally transversely as the hot mix asphalt material is conveyed by at least one pair of parallel, oppositely pitched, counter-rotating feed augers from a hopper to spreading augers of the asphalt paver.

PRINCIPAL OBJECTS AND ADVANTAGES OF THE INVENTION

The principal objects and advantages of the present invention include: to provide an asphalt paver that eliminates segregation in hot mix asphalt material delivered to the asphalt paver; to provide such an asphalt paver that includes at least one pair of parallel, oppositely pitched, counter-rotating feed augers for conveying hot mix asphalt material from a hopper of the asphalt paver to spreading augers of the asphalt paver; to provide such an asphalt paver that includes feed augers having paddle mechanisms that intermittently and generally transversely displace hot mix asphalt material being conveyed by the feed augers; to provide such an asphalt paver having feed augers with controllable rotational speeds; to provide such an asphalt paver having feed augers that are driven by hydraulic motors; to provide such an asphalt paver that has elongate members superimposed over feed augers for protecting the feed augers, for preventing overloading of the feed augers, and for enhancing lateral extraction of hot mix asphalt material from a hopper of the asphalt paver by the feed augers; to provide such an asphalt paver having a feed screen for controlling the flow of hot mix asphalt material to feed augers of the asphalt paver; to provide a kit for converting existing asphalt pavers whereby those pavers can substantially or entirely eliminate segregation in the hot mix asphalt material delivered to those pavers; to provide a method that is consistent with any or all embodiments of such an asphalt paver having a remixing conveyor system and with a kit for converting existing asphalt paving machines as herein provided; and to generally provide such an asphalt paver, kit and method that is economical to manufacture, efficient in operation, reliable in performance, capable of long operating life and/or particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The remixing conveyor system of the present invention provides a capability and a method for an asphalt paver to receive hot mix asphalt material having segregation characteristics and to remix that segregated hot mix asphalt material into a substantially uniform mixture before the hot mix asphalt material is placed by the asphalt paver into an asphalt paving mat on a subgrade.

Figure 1:
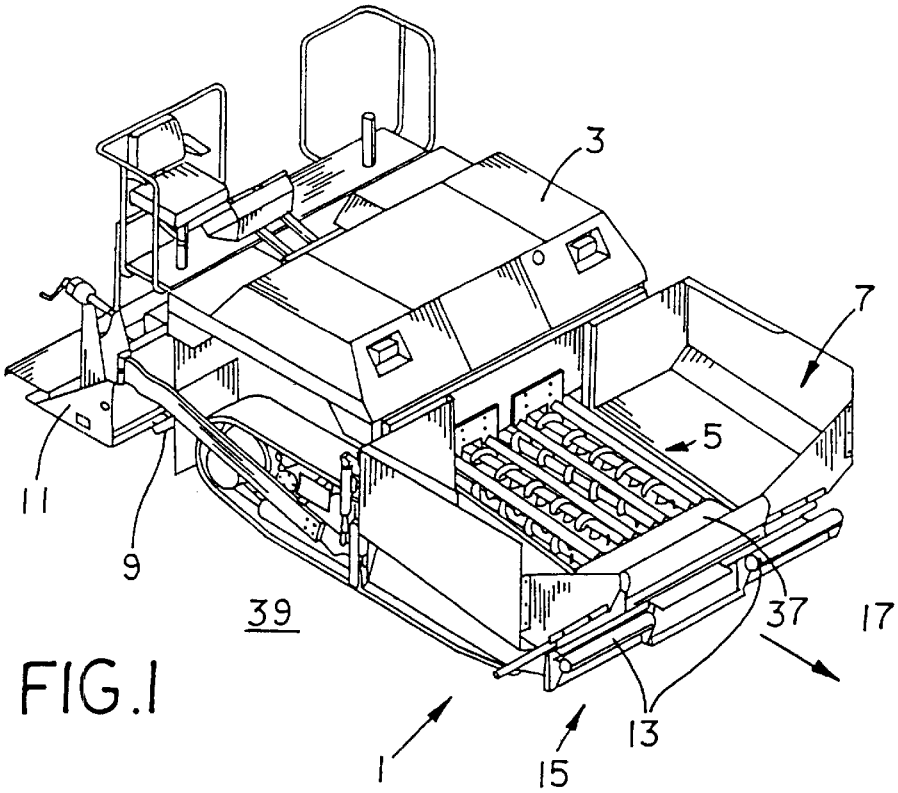
FIG. 1 is a perspective view of an asphalt paver with a remixing conveyor system, according to the present invention.
Figure 2:
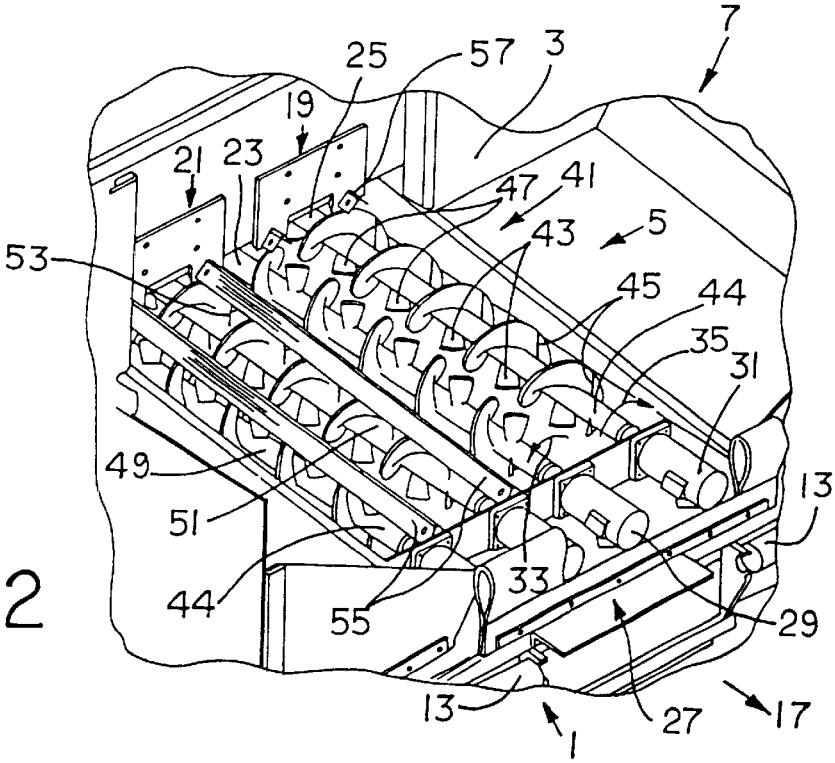
FIG. 2 is an enlarged and fragmentary, perspective view of the asphalt paver with a remixing conveyor system, with portions cut away and components removed to reveal details thereof.
Figure 3:
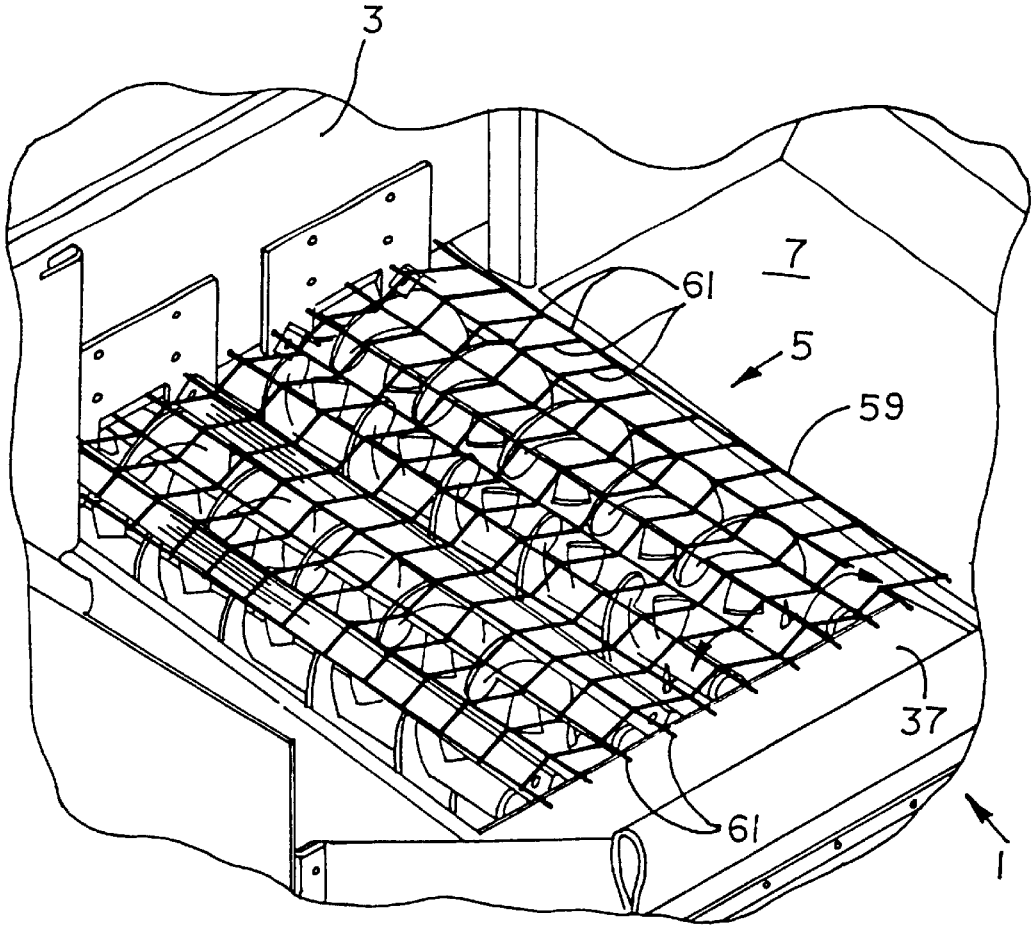
FIG. 3 is an enlarged and fragmentary, perspective view of the asphalt paver with a remixing conveyor system showing a feed screen, according to the present invention.

The reference numeral 1 generally refers to an apparatus comprising a remixing conveyor system in accordance with the present invention, as shown in FIGS. 1 through 3. The apparatus 1 generally includes a paver 3 and desegregation or remixing means 5.

The paver 3 includes a hopper. 7, spreading means 9, and a screed 11. The hopper 7 is adapted to receive hot mix asphalt material (not shown) from a truck (not shown) that has been backed up against bumper rollers 13 situated at a front 15 of the paver 3. The spreading means 9 generally comprise a pair of opposing screw or spreading augers that distribute the hot mix asphalt material in front of the screed 11, generally transversely to the direction of travel 17 of the paver 3. The screed 11 levels and partially compacts the hot mix asphalt material distributed by the spreading means 9 for subsequent compaction by an asphalt roller machine (not shown).

The remixing means 5 generally includes two feed auger assemblies 19 and 21. The feed auger assembly 19 includes a pair of feed augers 23 and 25 spaced substantially parallel to each other and to the direction of travel 17 of the paver. Preferably, one of the feed augers 23 or 25 has a left-hand pitch whereas the other one of the feed augers 25 or 23 has a right-hand pitch. The feed augers 23 and 25 extend from the front of the hopper 7 to the vicinity of the spreading means 9. Driving means 27, such as pair of hydraulic motors 29 and 31, are adapted to counter-rotate the feed augers 23 and 25 about their respective longitudinal axes, as indicated by the arrows designated by the numerals 33 and 35 in FIG. 2.

It is to be understood that the feed augers 23 and 25 may be similarly pitched and both similarly rotated, either clockwise or counterclockwise as appropriate in order to convey the hot mix asphalt material from the hopper 7 to the vicinity of the spreading means 9. It is to be further understood that the motors 29 and 31 may be spaced at the front of the feed augers 23 and 25 under a removable protective cover 37, as shown in FIG. 1, or at the rear of the feed augers 23 and 25, in which case hydraulic hoses (not shown) to the motors 29 and 31 can generally be shortened considerably and the front of the hopper 7 can be spaced more closely to the front 15 of the paver 3.

As the feed augers 23 and 25 rotate about their respective longitudinal axes, hot mix asphalt material is extracted from the hopper 7 by the feed augers 23 and 25 and is deposited in front of the spreading means 9 on the subgrade 39. For some applications, it may be desirable that the peripheral diameter of portions of the feed augers 23 and 25 situated within the hopper 7 to be tapered in order to more uniformly draw hot mix asphalt material both from the front of the hopper 7 and from the back of the hopper 7. For example, the feed augers 23 and 25 may each have a peripheral diameter of approximately six inches at their respective front ends 23*a,* 25*a* located at the front of the hopper 7, a peripheral diameter of approximately ten inches at their respective rearward ends 23*b,* 25*b* located at the back of the hopper 7, and a spacing between the longitudinal axes of the feed augers 23 and 25 of approximately thirteen inches. Preferably, the peripheral diameter of each of the feed augers 23 and 25 are substantially uniform from the back of the hopper 7 to the rearmost extremities of the feed augers 23 and 25 whereat the hot mix asphalt material is placed in front of the spreading means 9.

For other applications, relatively uniform extraction of hot mix asphalt material from both the front and rear of the hopper 7 may be of lesser concern, such as when the hot mix asphalt material received from trucks is dumped predominantly near the front of the hopper 7. In that event, the peripheral diameter of each of the feed augers 23 and 25 may be substantially uniform from the front of the hopper 7 to the rearmost extremities of the feed augers 23 and 25. For example, the feed augers 23 and 25 may have a uniform peripheral diameter of approximately ten inches and a pitch of approximately ten inches. It is to be understood that each of the feed augers 23 and 25 may be a single unit or may be constructed in sections that are removably attached together.

If desired and to further improve the efficiency of the remixing means 5, each of the feed augers 23 and 25 may have mixing enhancing means 41, such as at least one remixing blade 43 extending generally radially outwardly from a shaft 44 of each of the feed augers 23 and 25. Preferably, the enhancing means 41 comprises a series of the remixing blades 43 spaced intermediately between adjacent turns of the spirals of the feed augers 23 and 25, as shown in FIG. 2. The remixing blades 43 are oriented approximately 45° relative to the longitudinal axis, and generally opposite to the orientation of the pitch, of the respective feed auger 23 or 25. Preferably, the series of remixing blades 43 are arranged in two rows 45 and 47 spaced 180° from each other about the longitudinal axis of the respective feed auger 23 or 25 such that the respective remixing blades 43 are staggered along the longitudinal axis of the respective feed auger, 23 or 25. It is to be understood that one or more of the feed augers 23 and 25 may have more than two rows of the remixing blades 43.

Due to the arrangement of the remixing blades 43, as the feed augers 23 and 25 rotate about their respective longitudinal axes, the remixing blades 43 tend to displace the hot mix asphalt material forwardly toward the front of the hopper 7 as the spirals of the feed augers 23 and 25 displace the hot mix asphalt material rearwardly for discharge from the paver 3 with the result that the hot mix asphalt material in the vicinity of the remixing blades 43 is displaced intermittently side to side, or generally transversely relative to the direction of travel 17 of the paver 3. Thus, enhanced remixing of the hot mix asphalt material in the vicinity of the feed augers 23 and 25 occurs thereby preventing further segregation and further, substantially or entirely curing existing segregation of the hot mix asphalt material as it is being conveyed generally rearwardly by the feed augers 23 and 25. It is to be understood that the remixing blades 43 may be fixedly attached to the feed augers 23 and 25, or may be detachable whereby the remixing blades 43 can be selectively replaced or removed.

Similarly to the feed auger assembly 19, the feed auger assembly 21 includes a pair of parallelly spaced, oppositely rotated, and oppositely pitched feed augers 49 and 51, each with rows of remixing blades 53. The peripheral dimensions and orientation of, and spacing between, the feed augers 49 and 51 are substantially similar to those of the feed augers 23 and 25. It is to be understood that some applications may require only one of the feed auger assemblies 19 or 21; further, some applications may require more than two of the feed auger assemblies 23 and 25.

The spacing between the two feed auger assemblies 19 and 21 is arranged to efficiently convey substantial quantity of the hot mix asphalt material contained in the hopper 7 to the spreading means 9. For example, the spacing between the innermost feed auger 23 of the feed auger assembly 19 and the innermost feed auger 51 of the feed auger assembly 21 may be approximately twenty inches. In such an example, the feed auger assemblies 19 and 21 can remix and convey hot mix asphalt material at the rate of approximately three hundred tons per hour as the feed augers 23, 25, 49 and 51 are rotated at approximately one hundred forty revolutions per minute. It is to be understood that the feed augers 23, 25, 49 and 51 may be operated at any rotational speed up to their maximum design limits.

Generally, each of the feed augers 23, 25, 49 and 51 is centered below a respective elongate member 55, as shown in FIGS. 1 and 2. Each of the elongate members 55 are superimposed above a respective one of the feed augers 23, 25, 49 or 51 and is sufficiently spaced apart therefrom to avoid interfering with the rotation thereof. Preferably, the elongate members 55 are constructed of angle stock, such as 3"×3"×¼" material, or other suitable material. Both ends of the elongate members 55 are attached to the paver 3, such as by brackets 57, as shown in FIG. 2.

The elongate members 55 provide some protection for the underlying feed augers 23, 25, 49 and 51 from the impact of hot mix asphalt material being dumped into the hopper 7 from trucks. In addition, the elongate members 55 help support the weight of hot mix asphalt material contained in the hopper 7 above the feed augers 23, 25, 49 and 41 to prevent operably overloading of the feed augers 23, 25, 49 and 51. Further, the spacing of the elongate members 55 encourage their respective feed augers 23, 25, 49 or 51 to draw hot mix asphalt material more laterally from the hopper 7 rather than from the hot mix asphalt material disposed more directly above the respective feed augers 23, 25, 49 and 51.

To further prevent overloading of the feed augers 23, 25, 49 and 51 and to encourage the feed augers 23, 25, 49 and 51 to draw hot mix asphalt material more laterally from the hopper 7, the apparatus 1 may optionally include a feed screen 59, as shown in FIG. 3. The feed screen 59 should have sufficient structural strength to withstand the environment within the hopper 7 consistent with the forces and abusiveness involved during the placement of hot mix asphalt material in the hopper 7 and the removal of hot mix asphalt material from the hopper 7. For example, the feed screen 59 may be constructed of criss-crossing bars or rods 61 having a diameter of approximately ⅝ inch and the bars or rods 61 spaced on approximately 4½ inch centers. The feed screen 59 may be placed in abutting engagement with the elongate members 55 to provide additional support for the feed screen 59.

The remixing conveyor system 5 of the present invention can be used in kit form to upgrade and convert existing asphalt paving machines and provide those asphalt paving machines with the ability to substantially or entirely eliminate segregation from hot mix asphalt material placed in those asphalt paving machines. The parallel slat conveyors of existing asphalt paving machines, each of which conveyor generally consists of two parallel chains with a multitude of transverse bars connected between them to convey hot mix asphalt material from the receiving hopper to the rear of the asphalt paving machine, are removed and replaced with one of the feed auger assemblies 19 for each of the slat conveyors so removed. Included with each of the replacement feed auger assemblies 19 are the associated elongate members 55. In addition, each such upgrade conversion may include the optional feed screen 59. After the conversion, the upgraded paving machine can then remix and substantially or entirely eliminate segregation from the hot mix asphalt material being placed by the asphalt paving machine.

The present invention includes a method for enabling an existing asphalt paving machine, having one or more slat conveyors and a spreading auger, to remove segregation from hot mix asphalt material placed in a hopper of the asphalt paving machine. The method includes the step of replacing each of the slat conveyors with a pair of parallelly spaced feed augers, either similarly pitched and rotated or oppositely pitched and counter rotated as desired. To provide the additional functions as hereinbefore described, the method may also include the step of superimposing an elongate member over each of the feed augers of each pair of the feed augers. In addition, the method may also include the step of superimposing a feed screen over the elongate members as hereinbefore described.

It is to be understood that the present invention may be used to remix materials, other than hot mix asphalt material, that tend to exhibit segregation.

It is to be understood that while certain forms of the present invention have been illustrated and described herein, it is not to be limited to the specific forms or arrangement of parts described and shown.

What is claimed and desired to be secured by Letters Patent is as follows:

1. A method comprising the steps of:

providing a hopper for receiving a hot, pre-mixed asphalt material;

loading the hot pre-mixed asphalt material into the hopper;

providing a spreader arranged to distribute the hot pre-mixed asphalt material generally transversely relative to a direction of travel to form a mat;

providing at least one pair of axially rotatable feed augers in the hopper, the feed augers being disposed generally parallel to the direction of travel;

providing at least one mixing blade on each of the feed augers, the mixing blade mounted on a shaft of the feed augers and arranged to displace the asphalt material generally transversely relative to a longitudinal axis of each of the feed augers as the feed augers convey the hot mix asphalt material;

rotating the feed augers thereby conveying the hot pre-mixed asphalt material from the hopper to the spreader and further thereby re-mixing the hot pre-mixed asphalt material as the hot pre-mixed asphalt material is being conveyed; and spreading the re-mixed asphalt material to form the mat.

2. The method of claim 1, further comprising the step of controlling the rotational speed of the feed augers.

3. A method of re-mixing hot mix asphalt material in an asphalt paver as the asphalt paver moves along a path comprising the steps of:

providing a hopper for receiving the hot mix asphalt material;

loading the hot mix asphalt material into the hopper;

providing a spreader arranged to spread the hot mix asphalt material generally transversely from a longitudinal axis of the hopper to form a mat; and providing a pair of oppositely pitched and counter- rotatable feed augers disposed within the hopper, each of the feed augers including a central shaft having helical flighting and a plurality of remixing blades disposed at intervals along the central shaft intermediately of the flighting, the remixing blades adapted to repeatedly displace at least a portion of the hot mix asphalt material in a generally transverse direction as the hot mix asphalt material is being conveyed toward the spreader thereby remixing the hot mix asphalt material in a remixing zone defined between the feed augers.

4. A method of forming a mat of hot mix asphalt material comprising the steps of:

providing an asphalt paver having a hopper for receiving the hot mix asphalt material;

loading the hopper with hot mix asphalt material;

providing a pair of spaced apart axially rotatable helical feed augers in the hopper, the feed augers substantially spanning the hopper and being disposed generally parallel to a path of the asphalt paver, the feed augers arranged to convey the asphalt material from the hopper toward the spreader, the feed augers further defining a remixing zone therebetween wherein the asphalt material is desegregated laterally relative to the path as the asphalt material is conveyed by the augers, the feed augers each including at least one blade mounted to a central shaft, the blade arranged to urge at least a portion of the asphalt material into the remixing zone in response to rotation of the feed augers;

rotating the feed augers to thereby remix the hot mix asphalt material into a homogenous mixture and further to thereby convey the hot mix asphalt material from the hopper to the spreader; and spreading the hot mix asphalt material using the spreader to form a mat.

5. The method of claim 4, wherein each of the feed augers includes a tapered peripheral diameter.

6. The method of claim 4, wherein the feed augers are rotated in opposite directions.

7. The method of claim 4, including the step of providing a second pair of feed augers.

8. An asphalt mat having substantially uniform aggregate distribution produced by the process of:

providing an asphalt paver moveable along a path, the asphalt paver having a hopper for receiving a hot mix asphalt material and a spreader for spreading the hot mix asphalt material into a mat;

loading the hopper with the hot mix asphalt material, the hot mix asphalt material exhibiting aggregate segregation;

providing a pair of feed augers in the hopper, the feed augers substantially spanning the hopper and being disposed generally parallel to the path, the feed augers further including tapered helical flighting;

rotating the feed augers to thereby remix the hot mix asphalt material and to further convey the hot mix asphalt material from the hopper toward the spreader;

spreading the hot mix asphalt material using the spreader to form the mat.

9. An asphalt mat having substantially homogenous aggregate distribution produced by the process of:

providing an asphalt paver moveable along a path, the asphalt paver having a hopper for receiving a hot mix asphalt material and a spreader for spreading the hot mix asphalt material into a mat;

loading the hopper with the hot mix asphalt material, the hot mix asphalt material being non-homogeneous;

providing a pair of feed augers in the hopper, each of the feed augers having helical flighting, the feed augers defining therebetween a remixing zone, the feed augers being disposed generally parallel to the path;

rotating the feed augers to thereby remix the hot mix asphalt material in the remixing zone to form a substantially homogeneous mixture and to further convey the hot mix asphalt material from the hopper toward the spreader;

spreading the hot mix asphalt material to form the mat.

10. An asphalt mat having substantially uniform aggregate distribution produced by the process of:

providing an asphalt paver moveable along a path, the asphalt paver having a hopper for receiving a hot mix asphalt material and a spreader for spreading the hot mix asphalt material into a mat;

loading the hopper with the hot mix asphalt material, the hot mix asphalt material having a non-uniform aggregate distribution;

providing a remixing zone extending between the hopper and the spreader, the remixing zone defined at least in part by a pair of spaced apart axially rotatable feed augers having helical flighting, each of the feed augers including means for urging at least a portion of the asphalt material generally laterally relative to the path in response to rotation of the feed augers, the remixing zone being disposed generally parallel to the path;

remixing the hot mix asphalt material in the remixing zone so that the hot mix asphalt material has a substantially uniform aggregate distribution;

spreading the hot mix asphalt material to form the mat.

* * * * *